US008186082B2

(12) United States Patent
Sato et al.

(10) Patent No.: US 8,186,082 B2
(45) Date of Patent: May 29, 2012

(54) FLUID PRESSURE DRIVE UNIT AND SNOW REMOVAL UNIT

(75) Inventors: Osamu Sato, Minokamo (JP); Yoshitake Sakai, Toki (JP); Shiro Nishioka, Kani (JP)

(73) Assignee: Kayaba, Tokyo (JP)

( * ) Notice: Subject to any disclaimer, the term of this patent is extended or adjusted under 35 U.S.C. 154(b) by 438 days.

(21) Appl. No.: 12/604,401

(22) Filed: Oct. 23, 2009

(65) Prior Publication Data

US 2010/0101120 A1 Apr. 29, 2010

Related U.S. Application Data

(63) Continuation of application No. PCT/JP2008/058441, filed on Apr. 24, 2008.

(30) Foreign Application Priority Data

Apr. 25, 2007 (JP) ..... 2007-114960

(51) Int. Cl.
*E01H 5/04* (2006.01)

(52) U.S. Cl. ..... 37/234

(58) Field of Classification Search ..... 37/219–236, 37/272, 414–417; 701/50; 172/2–11, 701.1, 172/701.3, 810–818; 60/476, 488; 91/468, 91/452, 442, 494; 251/63.4, 82; 137/512.2, 137/512.3, 516.27

See application file for complete search history.

(56) References Cited

U.S. PATENT DOCUMENTS

| | | | | |
|---|---|---|---|---|
| 2,674,052 | A * | 4/1954 | Newkirk | 172/701.3 |
| 3,656,559 | A * | 4/1972 | Lennea et al. | 172/818 |
| 3,706,144 | A | 12/1972 | Miceli | |
| 4,231,432 | A * | 11/1980 | Jennings | 172/7 |
| 4,727,665 | A * | 3/1988 | Verseef | 37/236 |
| 6,035,944 | A * | 3/2000 | Neuner et al. | 172/818 |
| 6,422,127 | B1 | 7/2002 | Huber et al. | |
| 6,691,435 | B1 | 2/2004 | Schultz et al. | |

FOREIGN PATENT DOCUMENTS

| | | |
|---|---|---|
| EP | 1101692 A | 5/2001 |
| JP | A 2006-132604 | 5/2006 |

* cited by examiner

*Primary Examiner* — Robert Pezzuto
(74) *Attorney, Agent, or Firm* — Hiroe & Associates; Dwayne L. Bentley

(57) ABSTRACT

There is provided a fluid pressure drive unit that can fulfill a position holding function stably even when an external force acts during the time when the position is held, the unit being used, for example, for the right and left angle adjustment of a snow plow blade. There is provided a first excessive load relief valve 6 for letting a working fluid escape from a bottom-side pipe line 10*a*, which connects the bottom-side port of a single-rod double acting cylinder 2 to the bottom side of an operate check valve 4, to a rod-side pipe line 10*b*, which connects the rod-side port of the single-rod double acting cylinder 2 to the rod side of the operate check valve 4, and there is provided a second excessive load relief valve 7 for letting the working fluid escape from the rod-side pipe line 10*b* to a tank 3. Also, there is provided a negative pressure preventing check valve 8 for allowing the working fluid to flow into the bottom-side pipeline 10*a* from the tank 3.

6 Claims, 4 Drawing Sheets

FLUID PRESSURE DRIVE UNIT AND SNOW REMOVAL UNIT

RELATED APPLICATIONS

This application is a continuation of International Application PCT/JP2008/058441, with an international filing date of Apr. 24, 2008, and a publication date of Nov. 6, 2008, which claims priority to Japanese Patent Application JP2007-114960, having a filing date of Apr. 25, 2007, now pending, all of which are hereby incorporated herein by reference.

TECHNICAL FIELD

The present invention relates to a fluid pressure drive unit that imparts a fluid or hydraulic pressure driving force to a driven body independently, for example, a fluid pressure drive unit that can be used for angle adjustment around the vertical axis of a snow plow blade of a snow removal device, and a snow removal device that uses the fluid pressure drive unit.

BACKGROUND ART

Fluid pressure drive units have been used in many fields because a driving force of fluid pressure can be obtained easily if only a power source is present. For example, the fluid pressure drive unit can be used for angle adjustment around the vertical axis of a snowplow blade of a snow removal device that is detachably mounted in front of a vehicle.

One example is the snow removal device described in Patent Document 1. FIG. 3 of the current application is a hydraulic circuit diagram of a snow removal device that is background art to the present invention.

A snow removal device 70 includes a hydraulic pump 51 driven by an electric motor M, a pair of single-acting cylinders 52A and 52B that make angle adjustments (right and left angle adjustments) around the vertical axis of a snow plow blade 61, a pressure-oil tank 53, a change valve 54 for changing over the supply of hydraulic oil sent from the hydraulic pump 51 to the single-acting cylinder 52A or 52B, an overload relief valve 55 used in the case of overload, and a main relief valve 56 that determines the specified working pressure of the snow removal device 70.

The snow removal device 70 further includes a change valve 62 for changing over the supply of hydraulic oil sent from the hydraulic pump 51 to the right and left angle adjustment side or the up and down adjustment side of the snow plow blade 61, a single-acting cylinder 63 for up and down adjustment, a return valve 64 for returning the hydraulic oil to the pressure-oil tank 53 when the single-acting cylinder 63 lowers, and a controller 65 for angle adjustment and up and down adjustment.

With the above-described configuration, the snow removal device 70 can make not only right and left angle adjustments but also up and down position adjustments to the snow plow blade 61 by utilizing the hydraulic drive.

For the snow removal device 70, the two single-acting cylinders 52A and 52B are used to make the right and left angle adjustments to the snowplow blade 61. However, to reduce the cost and to make the unit compact, one single-rod double acting cylinder should be used if possible. For this purpose, it is necessary to solve a problem in that the quantity of hydraulic oil differs between the bottom side and the rod side of the cylinder.

As a solution to the problem that the quantity of hydraulic oil differs between the bottom side and the rod side of the cylinder where one single-rod double acting cylinder is used, the hydraulic drive unit described in Patent Document 2 (proposed by the applicant of the present invention) can be used. The basic configuration and basic operation of this hydraulic drive unit are explained below.

FIG. 4 is a hydraulic circuit diagram of a fluid pressure drive unit that is background art to the present invention.

A hydraulic drive unit OU includes a hydraulic pump OP that sends hydraulic oil under pressure in both of the forward and reverse directions by means of a forward/reverse rotation motor M to impart a hydraulic driving force to a driven body W independently as hydraulic oil is circulated in a closed system. The system's basic components also include a hydraulic actuator OA (herein, a hydraulic cylinder) that is operated by the hydraulic oil to generate the driving force, a tank OT for storing the hydraulic oil in a closed space, an operate check valve OC that controls the flow of hydraulic oil in both of the forward and reverse directions between the hydraulic pump OP and the hydraulic actuator OA, and a change valve OI that controls the flow of hydraulic oil in both of the forward and reverse directions between the hydraulic pump OP and the tank OT.

The operate check valve OC includes a pair of check valves OCa that basically allow only the flow of hydraulic oil from the hydraulic pump OP to the hydraulic actuator OA, and a pair of pilot lines OCb that pilot the hydraulic oil pressure sent to one check valve OCa to the other check valve Oca.

These paired check valves OCa are provided in a pipe line that connects one port of the hydraulic pump OP and a bottom-side fluid chamber OAa of the hydraulic actuator OA to each other and in a pipe line that connects the other port of the hydraulic pump OP and a rod-side fluid chamber OAb of the hydraulic actuator OA to each other.

The change valve OI connects and disconnects either of the pipe lines between the hydraulic pump OP and the bottom-side fluid chamber OAa of the hydraulic actuator OA and between the hydraulic pump OP and the rod-side fluid chamber OAb of the hydraulic actuator OA to and from the tank OT.

In the explanation below, a left-hand side element in the figure of, for example, the pair of right and left check valves OCa, is sometimes referred to as a "bottom side" element because it relates to the hydraulic oil going into and out of the bottom-side fluid chamber OAa of the hydraulic actuator OA. An element on the right-hand side of the figure is thus sometimes referred to as a "rod side" element because it relates to the hydraulic oil going into and out of the rod-side fluid chamber OAb. Similarly, regarding the port of the hydraulic pump OP, the left-hand side is sometimes referred to as the bottom side, and the right-hand side as the rod side.

In a hydraulic drive unit OU configured as described above, when the hydraulic pump OP is stopped, the outflow of hydraulic oil from both of the bottom-side fluid chamber OAa and the rod-side fluid chamber OAb of the hydraulic actuator OA is inhibited, and the position of the hydraulic actuator OA is maintained against a given external force.

When the hydraulic pump OP is rotated so that hydraulic oil is discharged to the bottom-side port, the hydraulic oil is supplied from the hydraulic pump OA to the bottom-side fluid chamber OAa after passing through the bottom-side check valve OCa. At the same time, the rod-side check valve OCa is pushed open by the hydraulic oil pressure of the bottom-side pilot line OCb to allow the hydraulic oil to flow out of the rod-side fluid chamber OAb and into the hydraulic pump OP. This produces a flow of hydraulic oil circulating clockwise between the hydraulic pump OP and the hydraulic actuator OA, so that a driving force in the extension direction is generated in the hydraulic actuator OA.

As this is occurring, when the hydraulic actuator OA is a hydraulic cylinder as shown in the figure the amount of hydraulic oil flowing out of the rod-side fluid chamber OAb is less than the amount of hydraulic oil flowing into the bottom-side fluid chamber OAa by an amount corresponding to the volume of the rod of the piston with according to the displacement of the piston in the hydraulic cylinder. However, pressure from the bottom-side hydraulic oil changes the change valve OI over so that the pipeline to the rod-side fluid chamber OAb is connected to the tank OT, and hydraulic oil is thereby supplied from the tank OT to make up for this deficiency.

On the other hand, when the hydraulic pump OP is rotated so that hydraulic oil is discharged to the rod-side port, a circulation flow of hydraulic oil reverse to the above is produced, and therefore a driving force in the contraction direction is generated in the hydraulic actuator OA. An excess of hydraulic oil flows from the bottom-side fluid chamber OAa into the hydraulic pump OP. However, this excess hydraulic oil is returned to the tank OT because the pipe line to the bottom-side fluid chamber OAa is connected to the tank OT by the action of the change valve OI reverse to the above, and oil is thereby returned to the tank OT.

Depending on the position of the piston in the hydraulic cylinder (the hydraulic actuator OA), the quantity of hydraulic oil in the closed tank OT increases or decreases, and the pressure of the gas enclosed in the tank OT fluctuates. By making the volume of the enclosed gas proper, the fluctuations in gas pressure are prevented from influencing the operation of the hydraulic drive unit OU.

Thus, even though the hydraulic actuator is used in a closed system and there is a difference between the quantities of hydraulic oil going in and out of the cylinder, the function of the hydraulic drive unit OU is accomplished and maintained.

The hydraulic drive unit OU is provided with additional elements described below in addition to the basic elements described above.

Slow return valves SR that throttle only the flow of hydraulic oil from the fluid chambers OAa and OAb to the check valves OCa are provided in the pipe lines between the bottom-side fluid chamber OAa and the rod-side fluid chamber OAb of the hydraulic actuator OA and the check valves OCa of the operate check valve OC.

The slow return valve SR prevents hunting occurring when an external force is applied by the driven body W during the operation of the hydraulic pump OP.

A pipeline provided with a relief valve RV1 branches from the pipeline between the slow return valve SR and the check valve OCa to the tank OT. A similar pipeline provided with a relief valve RV2 branches to the tank OT from the pipeline between the hydraulic pump OP and the check valve OCa on the bottom side and the rod side.

The relief valves RV1 and RV2 let excessive hydraulic oil escape to the tank OT if an abnormal pressure occurs in the unbranched pipeline.

Another pipeline, this one provided with an emergency manual valve MV, branches to the tank OT from the pipeline between the bottom-side slow return valve SR and the check valve OCa. If the hydraulic pump OP stops because a power source is not present, the emergency manual valve MV opens the pipelines of the bottom-side fluid chamber OAa and the rod-side fluid chamber OAb of the hydraulic actuator OA to the tank OT so that the hydraulic actuator OA can be operated manually.

Using the configuration described above, even in the case where an abnormality occurs while the basic function of the hydraulic drive unit OU is attained properly, the hydraulic drive unit OU secures safety, reliability, and accident avoiding properties by preventing the abnormality from leading to damage to the unit OU.

When one attempts to use the hydraulic drive unit OU as it is for right and left angle adjustment of the snow plow blade of the snow removal device described above, and an excessive external force W acts suddenly due to large amounts of snow or obstacles while right or left angle adjustments are made to the snow plow blade and the angle is held (at this time, the hydraulic pump OP is stopped), the relief valve RV1 can return the hydraulic oil in one oil chamber with an excessively high pressure to the tank T, but cannot at the same time take in the deficient hydraulic oil in the other oil chamber with a negative pressure from the tank T. Therefore, a negative pressure is produced in the hydraulic actuator (cylinder) OA, and an unstable state in which the piston position cannot be held sometimes occurs, so that improvement of these situations has been desired.

That is to say, there are times when the angle of the snow plow blade is changed by an excessive external force W while the unit OU is not being operated. It is desirable then that the snow plow blade not be unstable, i.e., that the angle of the blade be unchanged after the excessive external force is removed. However, this need has not been met by the conventional hydraulic drive unit OU.

There has been a need for a hydraulic drive unit in which a stable position is held without operating the hydraulic pump OP even after an external force higher than the rated specification has acted on the hydraulic drive unit OU during a time when the load or the angle (position) is held, that is when the hydraulic pump OP is stopped.

Also, this problem is not limited to a unit using oil pressure, and is widely common to fluid pressure equipment.

[Patent Document 1] U.S. Pat. No. 3,706,144 (FIG. 1, reference numerals 76, 82, 88, FIG. 2)

[Patent Document 2] Japanese Unexamined Patent Application Publication No. 2006-132604 (FIG. 11, Paragraphs [0004] [0021])

DISCLOSURE OF INVENTION

Technical Problem

The present invention has been made to solve the problems noted above, and accordingly an object of the invention is to provide a fluid pressure drive unit that can hold a position stably even after an excessive external force has been encountered, the unit being used, for example, for the right and left angle adjustment of a snow plow blade, and a snow removal device using the fluid pressure drive unit.

Technical Solution

A fluid pressure drive unit of this invention, which gives a fluid pressure driving force to a driven body independently, comprising: a fluid pressure pump for sending a working fluid used in the unit under pressure in both of the positive and reverse directions; a single-rod double acting cylinder operated by the working fluid; a tank for storing the working fluid;

a pair of operate check valves which are interposed between the fluid pressure pump and the single-rod double acting cylinder to control the flow in both of the positive and reverse directions of working fluid therebetween; and a change valve, which is interposed between the fluid pressure pump and the tank to control the flow in both of the positive and reverse directions of working fluid therebetween, characterized in that there is provided a first excessive load relief valve for letting the working fluid escape from a bottom-side pipe line, which connects the bottom-side port of the single-rod double acting cylinder to the bottom-side operate check valve corresponding to the bottom-side port of the paired operate check valves, to a rod-side pipe line, which connects the rod-side port of the single-rod double acting cylinder to the rod-side operate check valve corresponding to the rod-side port of the paired operate check valves, and there is provided a second excessive load relief valve for letting the working fluid escape from the rod-side pipe line to the tank, and there is provided a negative pressure preventing check valve for allowing the working fluid to flow into the bottom-side pipeline from the tank.

A snow removal device detachably mounted in front of a vehicle of this invention, characterized in that the single-rod double acting cylinder of the fluid pressure drive unit of this invention is used for angle adjustment around the vertical axis of a snow plow blade of the snow removal device.

Advantageous Effects

According to the fluid pressure drive unit of this invention, there is provided a first excessive load relief valve for letting the working fluid escape from a bottom-side pipe line, which connects the bottom-side port of the single-rod double acting cylinder to the bottom-side operate check valve corresponding to the bottom-side port of the paired operate check valves, to a rod-side pipe line, which connects the rod-side port of the single-rod double acting cylinder to the rod-side operate check valve corresponding to the rod-side port of the paired operate check valves, and there is provided a second excessive load relief valve for letting the working fluid escape from the rod-side pipe line to the tank, and, there is provided a negative pressure preventing check valve for allowing the working fluid to flow into the bottom-side pipeline from the tank, so, the unit can hold a position stably even after an excessive external force has been encountered.

In this fluid pressure drive unit, when an excessive external force act on the contraction side during the time when the position is being held (the unit is stopped), only the excessive working fluid in a bottom-side fluid chamber of a single-rod double acting cylinder is returned to a tank via a first excessive load relief valve and a second excessive load relief valve.

On the other hand, when the excessive external force acts on the extension side, the excessive working fluid in a rod-side fluid chamber of the single-rod double acting cylinder is returned to the tank via the second excessive load relief valve. At this time, the working fluid necessary for the bottom-side fluid chamber is supplied from the tank via a negative pressure preventing check valve.

Therefore, neither the bottom-side fluid chamber nor the rod-side fluid chamber of the single-rod double acting cylinder have a negative pressure even after the piston position has been changed by the external force, and both of the fluid chambers are filled with the working fluid, so that the stable position holding function can be fulfilled continuously.

A snow removal device detachably mounted in front of a vehicle of this invention, characterized in that the single-rod double acting cylinder of the fluid pressure drive unit of this invention is used for angle adjustment around the vertical axis of a snow plow blade of the snow removal device, so the snow removal device can make, as the device, the same effects as the unit.

EXPLANATION OF REFERENCE

Figure 1:
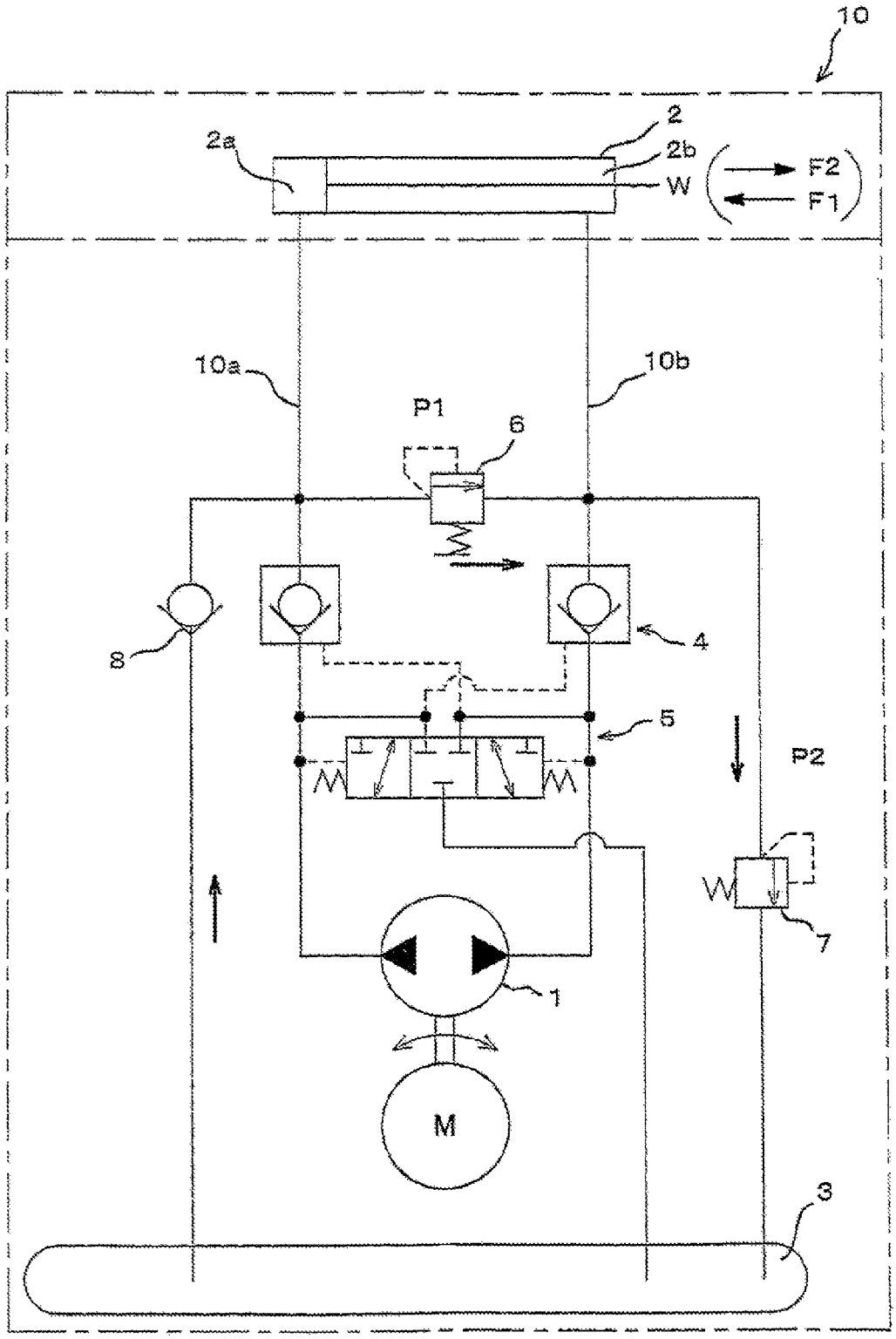
FIG. 1 is a fluid pressure circuit diagram showing one example of a fluid pressure drive unit in accordance with the present invention.

1 . . . fluid pressure pump
2 . . . single-rod double acting cylinder
3 . . . tank
4 . . . operate check valve
5 . . . change valve
6 . . . first excessive load relief valve
7 . . . second excessive load relief valve
8 . . . negative pressure preventing check valve
10, 10A . . . fluid pressure drive unit
10*a* . . . one-side pipe line
10*b* . . . the other-side pipe line
11 . . . snow plow blade
12 . . . up and down position adjusting change valve
12*a* . . . output port
13 . . . elevating single-rod single acting cylinder
20 . . . snow removal device

BEST MODE FOR CARRYING OUT THE INVENTION

Embodiments (examples) of the present invention will now be described with reference to the accompanying drawings.

Mode for the Invention 1

FIG. 1 is a fluid pressure circuit diagram showing one example of a fluid pressure drive unit in accordance with the present invention.

This fluid pressure drive unit 10 can be used where a large shock-like external force (excessive external force) acts while the position (angle) is being held, for example, when the fluid pressure drive unit 10 is used for angle adjustment (right and left angle adjustment) around the vertical axis of a snow plow blade of a snow removal device detachably mounted in front of a vehicle.

The fluid pressure drive unit 10 includes, as basic components, a fluid pressure pump 1 that sends a working fluid under pressure in both of the forward and reverse directions by means of a positive/reverse rotation motor M to impart a fluid pressure driving force to a driven body W (the snow plow blade) independently, that is, while hydraulic oil is circulated in a closed system. The drive unit further includes a single-rod double acting cylinder 2 that is operated by the working fluid to generate the driving force, a tank 3 for storing the working fluid in a closed space, operate check valves 4 that control the flow of working fluid in both of the forward and reverse directions between the fluid pressure pump 1 and the single-rod double acting cylinder 2, and a change valve 5 that controls the flow of working fluid in both of the forward and reverse directions between the fluid pressure pump 1 and the tank 3.

Figure 4:
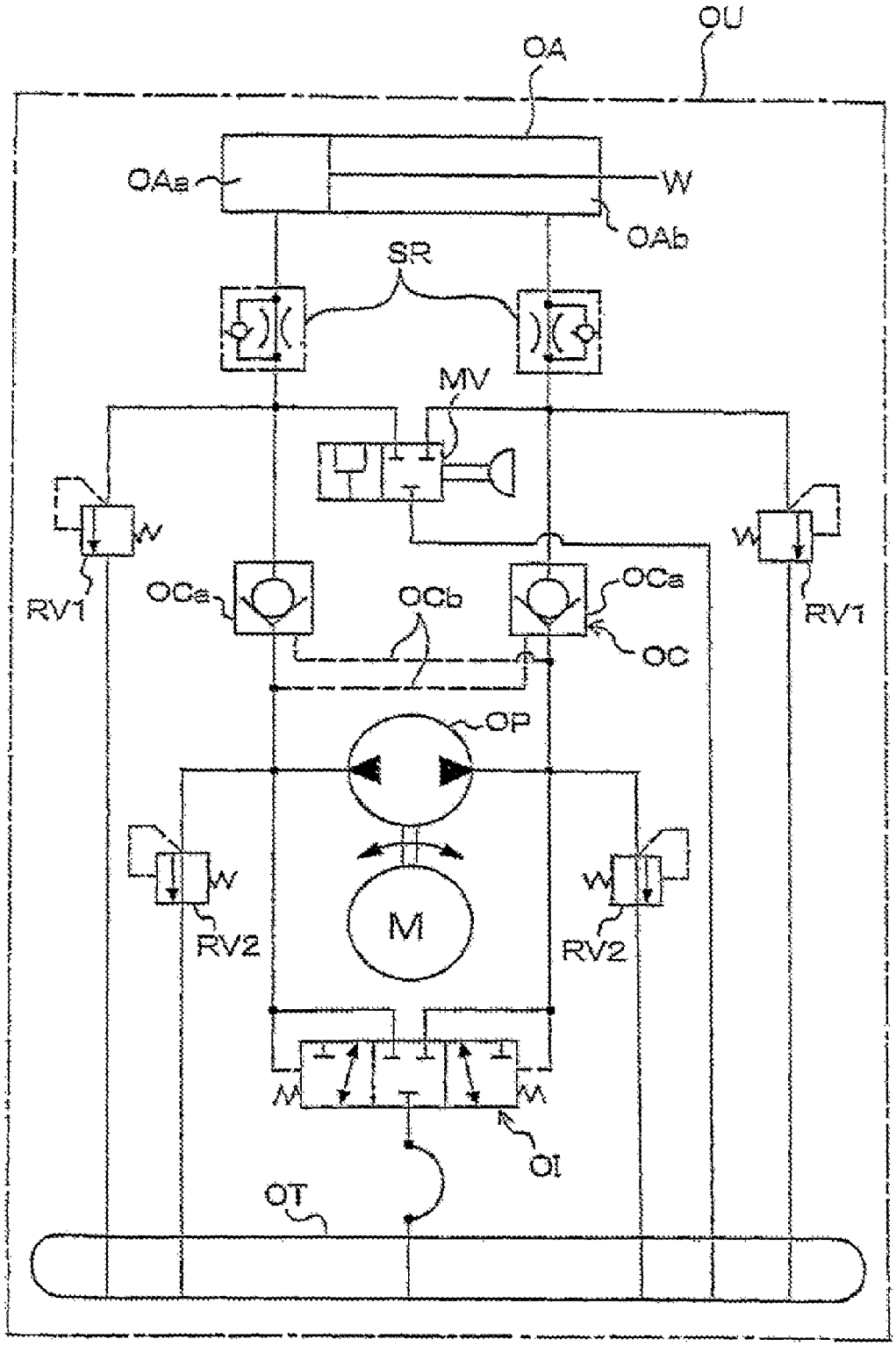
FIG. 4 is a hydraulic circuit diagram showing one example of a fluid pressure drive unit that is a background art of the present invention.

The basic functions and mutual relationship of the hydraulic pump 1, the hydraulic cylinder 2, the tank 3, the operate check valves 4, and the change valve 5 are the same as those of the hydraulic pump OP, the hydraulic actuator OA, the tank OT, the operate check valve OC, and the change valve OI that constitute the hydraulic drive unit OU of the background art explained above with reference to FIG. 4, and duplicate explanation of those parts is therefore omitted.

In FIG. 1, reference numeral 2*a* of the hydraulic cylinder 2 denotes a bottom-side fluid chamber, and 2*b* denotes a rod-side fluid chamber. FIG. 1 does not show the slow return valves SR, the emergency manual valve MV, and the relief valves RV2 provided in the hydraulic drive unit OU of the background art. However, these valves are provided as necessary.

Also, the terms bottom side and rod side are used in the same way as in the case of the hydraulic drive unit OU of the background art.

In addition to the above-described basic configuration, the fluid pressure drive unit 10 includes a first excessive load relief valve 6 for letting the working fluid escape from a bottom-side pipe line 10*a*, which connects the bottom side of the paired operate check valves 4 to the bottom-side fluid chamber 2*a* (bottom-side port) of the single-rod double acting cylinder 2, to a rod-side pipe line 10*b*, which connects the rod side of the paired operate check valves 4 to the rod-side fluid chamber 2*b* of the cylinder 2, as well as a second excessive load relief valve 7 for letting the working fluid escape from the rod-side pipe line 10*b* to the tank 3.

The fluid pressure drive unit 10 also has a negative pressure preventing valve 8 for allowing the working fluid to flow into the bottom-side pipe line 10*a* from the tank 3. These features are explained below.

When a specified difference in pressure is produced, the first excessive load relief valve 6 lets the working fluid escape from the bottom-side pipe line 10*a* toward the rod-side pipe line 10*b* only.

Therefore, in the case where an excessive force (F1) acts on the single-rod double acting cylinder 2 in the contraction direction, the pressure in the bottom-side pipeline 10*a* becomes higher than the pressure in the rod-side pipeline 10*b*. In the case where the difference in pressure becomes larger than a specified set pressure, the working fluid is let escape to the rod-side pipe line 10*b* by the first excessive load relief valve 6.

The second excessive load relief valve 7 lets the working fluid escape from the rod-side pipeline 10*b* to the tank 3. Therefore, the working fluid that is caused to flow from the first excessive load relief valve 6 to the rod-side pipe line 10*b* becomes excessive with respect to the same movement of the piston because the bottom-side fluid chamber 2*a* has a larger cross-sectional area than the rod-side fluid chamber 2*b* by the cross-sectional area of the rod. Therefore, when the pressure becomes higher than the set pressure, the excessive working fluid is allowed to escape to the tank 3 by the relief valve 7.

During this time, the bottom-side pipe line 10*a* does not have a negative pressure, so that the working fluid does not flow into the bottom-side pipe line 10*a* from the tank 3 via the negative pressure preventing check valve 8.

On the other hand, in the case where an excessive force (F2) acts on the single-rod double acting cylinder 2 in the extension direction, when the pressure becomes higher than the set pressure the working fluid flowing out of the rod-side fluid chamber 2*b* is allowed to escape to the tank 3 via the second excessive load relief valve 7.

At this time, the working fluid is not supplied to the bottom-side fluid chamber 2*a* through either the operate check valve 4 or the first excessive load relief valve 6, so that a negative pressure is produced. In this case, the working fluid flows into the bottom-side pipeline 10*a* from the tank 3 via the negative pressure preventing check valve 8.

At this time, an excessive working fluid is required for the bottom-side pipeline 10*a* because the bottom-side fluid chamber 2*a* has a larger cross-sectional area than the rod-side fluid chamber 2*b* by the cross-sectional area of the rod. The working fluid including this excess amount flows into the bottom-side pipeline 10*a* from the tank 3 via the negative pressure preventing check valve 8.

In this fluid pressure drive unit provided with the first excessive load relief valve 6, the second excessive load relief valve 7, and the negative pressure preventing check valve 8, even when an excessive external force acts during the time when the position is held, for example, when the drive unit is used for right and left angle adjustment of the snow plow blade, neither the bottom-side fluid chamber nor the rod-side fluid chamber of the single-rod double acting cylinder have a negative pressure even after the piston position has been changed by the external force, and both of the fluid chambers are filled with the working fluid, so that the stable position holding function can be fulfilled continuously.

Also, since the relief valve 6 is provided so as to let the working fluid escape from the bottom-side pipe line 10*a* to the rod-side pipe line 10*b*, the rod-side pipe line 10*b* does not have a negative pressure because of its construction. Therefore, the negative pressure preventing check valve 8 is sufficiently provided at one place in the bottom-side pipeline 10*a*. The cost can be reduced in this respect.

Also, the fluid pressure drive unit 10 is characterized in that the first excessive load relief valve 6 has a higher set pressure than the second excessive load relief valve 7.

By doing this, the load holding force can be shared so as to match the property of the fluid pressure actuator used in this unit 10, the property being such that the bottom-side fluid chamber 10*a* of the single-rod double acting cylinder 2 has a larger cross-sectional area than the rod-side fluid chamber 10*b* by the cross-sectional area of the rod.

Specifically, for example, in the case where the ratio of the cross-sectional area (A1) of the bottom-side fluid chamber 2*a* to the cross-sectional area (A2) of the rod-side fluid chamber 2*b* is 1.3:1, the ratio of the set pressure (P1) of the first excessive load relief valve 6 to the set pressure (P2) of the second excessive load relief valve 7 is set to be 1.5:1.

If the relationship is formed in this manner, the excessive load relief function is fulfilled suitably against both of the external force in the contraction direction and the external force in the extension direction.

More generally, when F1 is equal to the maximum load holding load (external force) in the contraction direction, and F2 is equal to the maximum load holding load (external force) in the extension direction, the following relational expressions hold.

$$P1=(F1+F2)/A1 \quad P2=F2/A2$$

Mode for the Invention 2

Figure 2:
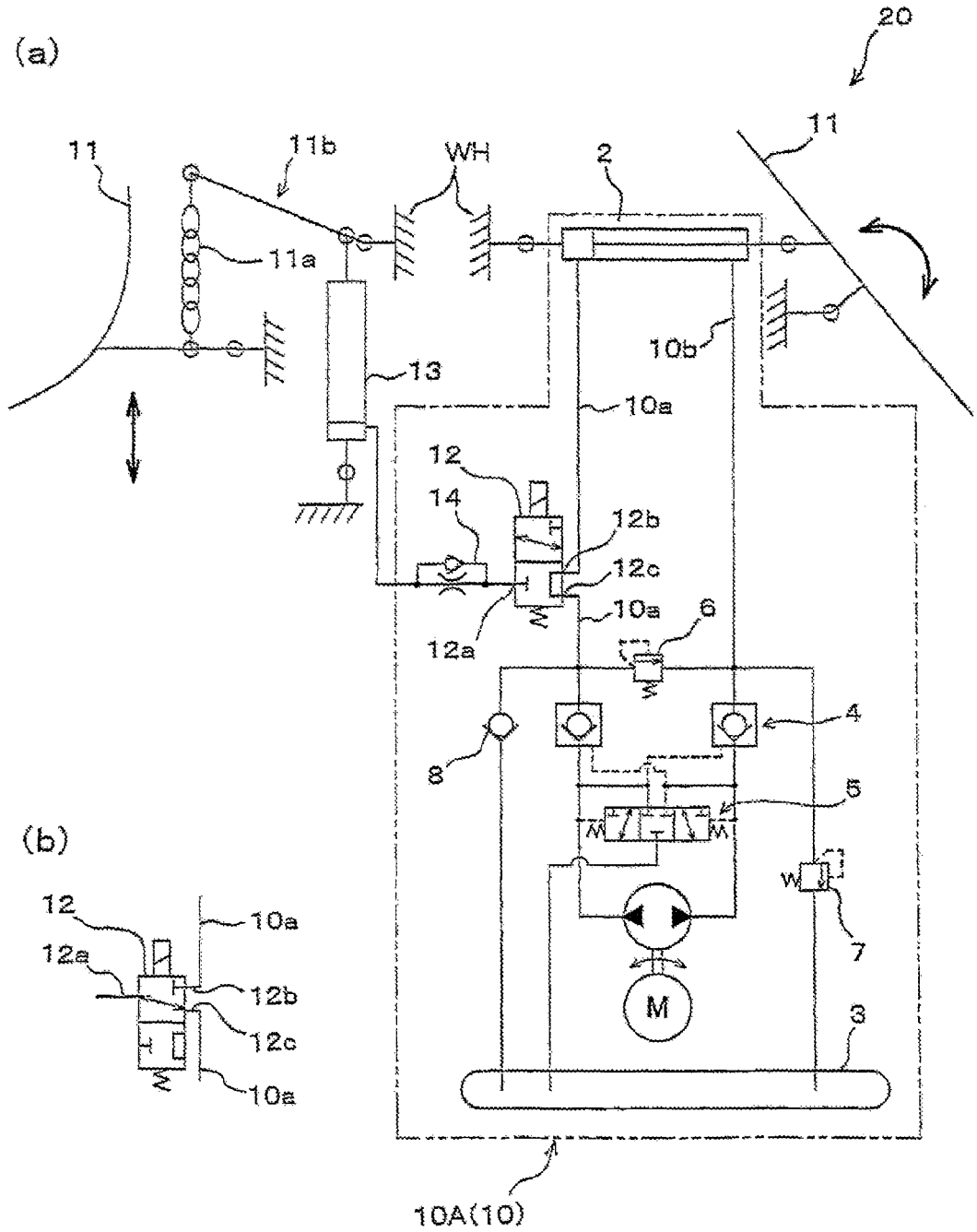
FIG. 2(*a*) is a fluid pressure circuit diagram schematically showing one example of a snow removal device using the fluid pressure drive unit shown in FIG. 1, and FIG. 2(*b*) is a view of an essential portion showing a state in which an up and down position adjusting change valve is at a position for up and down position adjustment compared with the state shown in FIG. 2(*a*)
Figure 3:
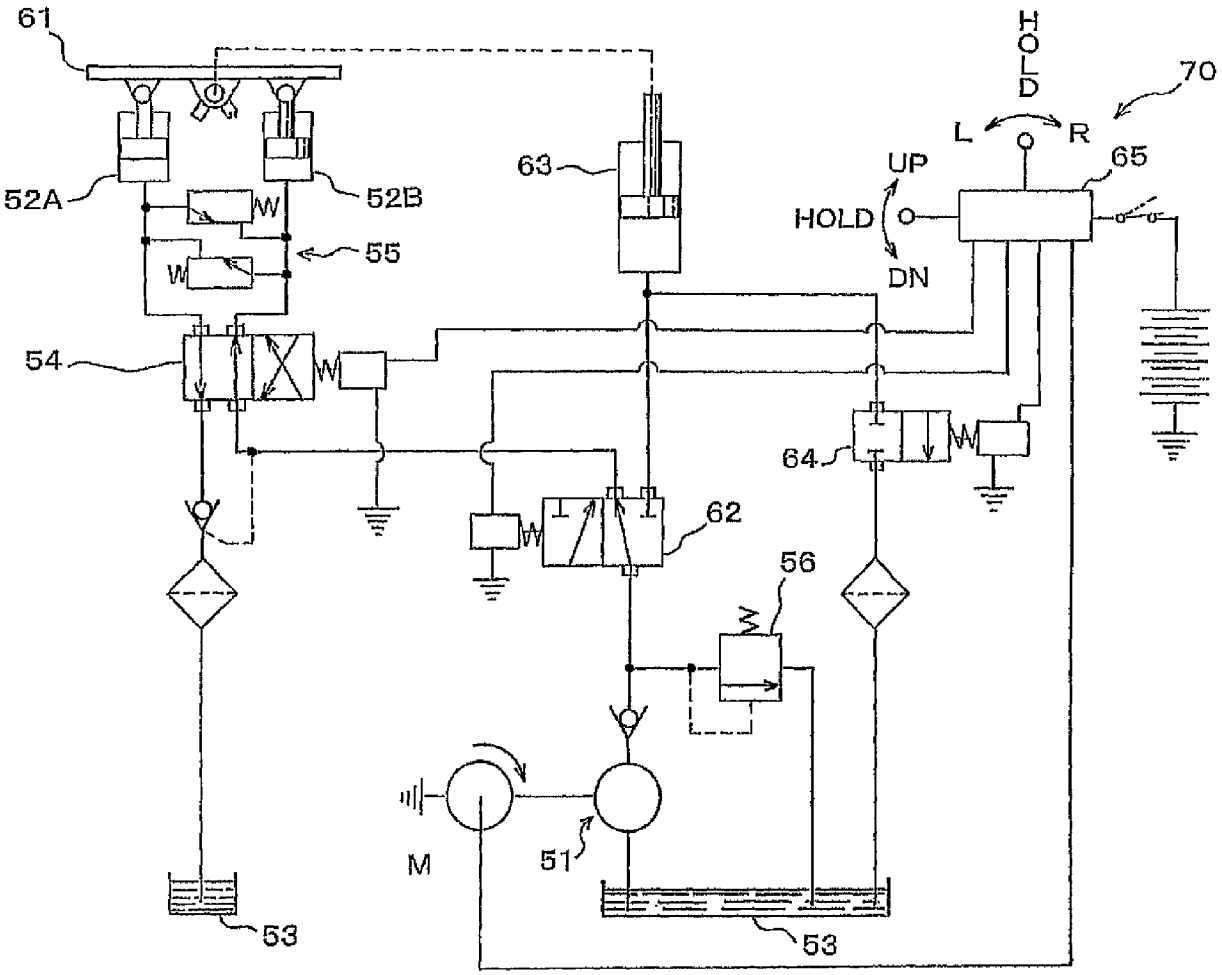
FIG. 3 is a hydraulic circuit diagram showing one example of a snow removal device that is a background art of the present invention.

FIG. 2(*a*) is a fluid pressure circuit diagram schematically showing one example of a snow removal device using the fluid pressure drive unit shown in FIG. 1, and FIG. 2(*b*) is a view of an essential portion showing a state in which an up and down position adjusting change valve is at a position for up and down position adjustment comparing with the state shown in FIG. 2(*a*).

This snow removal device 20 is detachably mounted in front of a vehicle WH, and uses the fluid pressure drive unit 10 shown in FIG. 1, and more specifically, the single-rod double acting cylinder 2 of this fluid pressure drive unit 10, to make angle adjustments (right and left angle adjustments) around the vertical axis of a snow plow blade 11.

In addition, the snow removal device 20 is characterized in that in order to make up and down position adjustments to the snow plow blade 11 as well by the fluid pressure drive unit 10, an up and down position adjusting change valve 12 is provided on the single-rod double acting cylinder 2 side of a portion in which the first excessive load relief valve 6 of the bottom-side pipe line 10*a* is provided so that one output port 12*b* thereof can be used for the up and down position adjustment of the snow plow blade 11.

That is to say, in the snow removal device 20, an input port 12*c* of the change valve 12 is connected to the first excessive load relief valve 6 side of the bottom-side pipe line 10*a*, one output port 12*a* is connected to an elevating single-rod single acting cylinder 13 for up and down position adjustment of the snow plow blade 11, and the other output port 12*b* is connected to the single-rod double acting cylinder 2 side of the bottom-side pipe line 10*a*.

In the case where the change valve 12 is at a position for right and left angle adjustment (the state shown in FIG. 2(*a*)), the other output port 12*b* communicates with the input port 12*c*, and the one output port 12*a* is cut off. In the case where the change valve 12 is at a position for up and down position adjustment (the state shown in FIG. 2(*b*)), the one output port 12*a* communicates with the input port 12*c*, and the other output port 12*b* is cut off.

Also, the snow removal device 20 is provided with a throttle valve 14, which throttles the flow rate in the return direction only, in a pipe line that connects the one output port 12*a* of the change valve 12 to the elevating single-rod single acting cylinder 13 for up and down position adjustment of the snow plow blade 11.

According to the snow removal device 20 configured as described above, when the change valve 12 is set on the single-rod double acting cylinder 2 side for right and left angle adjustment (position for right and left angle adjustment), on the up and down position adjustment side, the movement of working fluid is stopped. Therefore, the right and left angle adjustment can be made by forwardly or reversely rotating the pump 1 while the up and down position of the snowplow blade 11 is held.

In the case where an excessive external force acts in the up and down direction of the snow plow blade 11 in this state, this excessive force is mitigated by a support link mechanism 11*b* of the elevating single-rod single acting cylinder 13 for up and down position adjustment interposing a chain 11*a*, so that an adverse influence on the cylinder 13 is averted.

On the other hand, when the change valve 12 is set on the single-rod single acting cylinder 13 side for up and down position adjustment (position for up and down position adjustment), on the right and left angle adjustment side, the movement of working fluid is stopped. Therefore, the snow plow blade 11 can be elevated by forwardly rotating the pump 1 so as to supply the working fluid to the bottom-side pipe line 10*a* while the right and left angle of the snow plow blade 11 is held.

In the case where the snow plow blade 11 is lowered, the pump 1 is rotated reversely so as to supply the working fluid to the rod-side pipe line 10*b* to give a pilot pressure to the operate check valve 4 on the bottom side, by which the working fluid is throttled by the throttle valve 14 and is returned to the tank 3 by the weight of the snow plow blade 11. Therefore, the snowplow blade 11 descends at a specified speed.

Thus, in the snow removal device 20, in the case where the change valve 12 is set on the single-rod double acting cylinder 2 side for right and left angle adjustment (position for right and left angle adjustment), the first excessive load relief valve 6, the second excessive load relief valve 7, and the negative pressure preventing check valve 8 on the fluid pressure drive unit 10 side perform their functions, so that the above-described effect of the fluid pressure drive unit 10 is achieved as the snow removal device 20 as well. Therefore, a stable position holding function is fulfilled and maintained even after the excessive external force in the right and left direction of the snowplow blade 11 has been removed.

As explained with reference to FIG. 2, the up and down position adjusting change valve 12 and the throttle valve 14 can be integrated as a laminated structure in a valve housing. In this case, a unit including the change valve 12 and the throttle valve 14 may be referred to as a fluid pressure drive unit 10A.

In this case, the fluid pressure drive unit 10A achieves the operation and effect obtained by the addition of the change valve 12 and the throttle valve 14 in addition to the operation and effect of the original fluid pressure drive unit 10.

The technical scope of the fluid pressure drive unit and the snow removal device in accordance with the present invention is not limited to the above-described examples. Various modifications and combinations can be made in the scope described in the claims and in the scope of the examples, and these modifications and combinations are also embraced in the technical scope of the present invention.

In this description, the fluid pressure means the pressure of any fluid that carries a driving force as a medium, such as oil pressure and water pressure.

INDUSTRIAL APPLICABILITY

The fluid pressure drive unit in accordance with the present invention can be used in the industrial fields in which the drive unit is requested to be capable of being used in the case where an excessive external force acts, for example, in the case of right and left angle adjustment of a snow plow blade. Also, the snow removal device in accordance with the present invention can be used in the industrial fields in which the unit is requested to be operated easily by a fluid pressure driving force merely by supplying a power source.

We claim:

1. A fluid pressure drive unit, which gives a fluid pressure driving force to a driven body independently, comprising:

a fluid pressure pump for sending a working fluid used in the unit under pressure in both of the positive and reverse directions;

a single-rod double acting cylinder operated by the working fluid;

a tank for storing the working fluid;

a pair of operate check valves which are interposed between the fluid pressure pump and the single-rod double acting cylinder to control the flow in both of the positive and reverse directions of working fluid therebetween; and a change valve, which is interposed between the fluid pressure pump and the tank to control the flow in both of the positive and reverse directions of working fluid therebetween, characterized in that there is provided a first excessive load relief valve for letting the working fluid escape from a bottom-side pipe line, which connects the bottom-side port of the single-rod double acting cylinder to the bottom-side operate check valve corresponding to the bottom-side port of the paired operate check valves, to a rod-side pipe line, which connects the rod-side port of the single-rod double acting cylinder to the rod-side operate check valve corresponding to the rod-side port of the paired operate check valves, and there is provided a second excessive load relief valve for letting the working fluid escape from the rod-side pipe line to the tank, and there is provided a negative pressure preventing check valve for allowing the working fluid to flow into the bottom-side pipeline from the tank.

2. The fluid pressure drive unit according to claim 1, characterized in that the first excessive load relief valve has a higher set pressure than the second excessive load relief valve.

3. A snow removal device detachably mounted in front of a vehicle, characterized in that the single-rod double acting cylinder of the fluid pressure drive unit described in claim 2 is used for angle adjustment around the vertical axis of a snow plow blade of the snow removal device.

4. The snow removal device according to claim 3, characterized in that an up and down position adjusting change valve is provided between the first excessive load relief valve of the bottom-side pipe line and the single-rod double acting cylinder, and one output port of the up and down position adjusting change valve is used for the up and down position adjustment of the snow plow blade.

5. A snow removal device detachably mounted in front of a vehicle, characterized in that the single-rod double acting cylinder of the fluid pressure drive unit described in claim 1 is used for angle adjustment around the vertical axis of a snow plow blade of the snow removal device.

6. The snow removal device according to claim 5, characterized in that an up and down position adjusting change valve is provided between the first excessive load relief valve of the bottom-side pipe line and the single-rod double acting cylinder, and one output port of the up and down position adjusting change valve is used for the up and down position adjustment of the snow plow blade.

* * * * *